US005664438A

United States Patent [19]

Bonaquist et al.

[11] Patent Number: 5,664,438

[45] Date of Patent: Sep. 9, 1997

[54] CRYOGENIC SIDE COLUMN RECTIFICATION SYSTEM FOR PRODUCING LOW PURITY OXYGEN AND HIGH PURITY NITROGEN

[75] Inventors: Dante Patrick Bonaquist, Grand Island; Susan Marie Sattan, Amherst, both of N.Y.

[73] Assignee: Praxair Technology, Inc., Danbury, Conn.

[21] Appl. No.: 689,793

[22] Filed: Aug. 13, 1996

[51] Int. Cl.[6] ..... F25J 3/04

[52] U.S. Cl. ..... 62/645; 62/647; 62/650; 62/900

[58] Field of Search ..... 62/645, 646, 647, 62/649, 650, 900, 910

[56] References Cited

U.S. PATENT DOCUMENTS

| | | | |
|---|---|---|---|
| 3,947,259 | 3/1976 | Frischbier | 62/650 X |
| 4,261,719 | 4/1981 | Gotoh et al. | 62/650 |
| 4,410,343 | 10/1983 | Ziemer . | |
| 4,507,134 | 3/1985 | Tomisaka | 62/647 |
| 4,529,425 | 7/1985 | McNeil | 62/650 |
| 4,582,518 | 4/1986 | Erickson | 62/650 |
| 4,705,548 | 11/1987 | Agrawal et al. | 62/645 |
| 4,769,055 | 9/1988 | Erickson . | |
| 4,796,431 | 1/1989 | Erickson . | |
| 5,006,139 | 4/1991 | Agrawal et al. | 62/650 |
| 5,163,296 | 11/1992 | Ziemer et al. | 62/650 |
| 5,341,646 | 8/1994 | Agrawal et al. | 62/900 X |
| 5,359,857 | 11/1994 | Honda | 62/650 |
| 5,363,656 | 11/1994 | Nagamura et al. | 62/647 |
| 5,392,609 | 2/1995 | Girault et al. . | |
| 5,582,035 | 12/1996 | Rathbone et al. | 62/900 X |

*Primary Examiner*—Christopher Kilner
*Attorney, Agent, or Firm*—Stanley Ktorides

[57] ABSTRACT

A cryogenic rectification system for producing low purity oxygen and high purity nitrogen, preferably at elevated pressure, wherein nitrogen-rich vapor from a higher pressure column is turboexpanded and condensed against lower pressure column intermediate liquid prior to being passed into the lower pressure column and low purity oxygen is produced in an auxiliary side column driven by fluid from the higher pressure column.

10 Claims, 2 Drawing Sheets

CRYOGENIC SIDE COLUMN RECTIFICATION SYSTEM FOR PRODUCING LOW PURITY OXYGEN AND HIGH PURITY NITROGEN

TECHNICAL FIELD

This invention relates generally to cryogenic rectification of air and, more particularly, to cryogenic rectification of feed air to produce oxygen and nitrogen. It is particularly useful for producing low purity oxygen and high purity nitrogen products at elevated pressures.

BACKGROUND ART

In some industrial applications it is desirable to use both low purity oxygen and high purity nitrogen. For example, in glassmaking, low purity oxygen is employed in oxy-fuel combustion to heat and melt the glassmaking materials while high purity nitrogen is used as an inerting atmosphere for the molten glass. Moreover, often the oxygen and the nitrogen are both required at elevated pressures.

Accordingly, it is an object of this invention to provide a cryogenic rectification system that can efficiently produce both low purity oxygen and high purity nitrogen.

It is another object of this invention to provide a cryogenic rectification system that can efficiently produce both low purity oxygen and high purity nitrogen at elevated pressure.

SUMMARY OF THE INVENTION

The above and other objects, that will become apparent to one skilled in the art upon a reading of this disclosure, are attained by the present invention, one aspect of which is:

A method for producing low purity oxygen and high purity nitrogen comprising:

(A) passing feed air into a higher pressure column and separating the feed air within the higher pressure column by cryogenic rectification into nitrogen-rich vapor and oxygen-enriched liquid;

(B) recovering a portion of the nitrogen-rich vapor as product high purity nitrogen, and passing oxygen-enriched liquid into a lower pressure column;

(C) turboexpanding a portion of the nitrogen-rich vapor to produce turboexpanded nitrogen-rich vapor, condensing turboexpanded nitrogen-rich vapor by indirect heat exchange with fluid from above the bottom of the lower pressure column to produce nitrogen-rich liquid, and passing nitrogen-rich liquid into the lower pressure column;

(D) separating the fluids passed into the lower pressure column by cryogenic rectification into nitrogen-richer fluid and oxygen-richer fluid;

(E) passing oxygen-richer fluid into an auxiliary side column and producing low purity oxygen by cryogenic rectification within the auxiliary side column, wherein liquid from the auxiliary side column is vaporized by indirect heat exchange with vapor from within 1 to 10 equilibrium stages above the bottom of the higher pressure column; and (F) recovering low purity oxygen product from the auxiliary side column.

Another aspect of the invention is:

Apparatus for producing low purity oxygen and high purity nitrogen comprising:

(A) a first column, a second column and means for providing feed air into the first column;

(B) means for recovering fluid from the upper portion of the first column, and means for passing fluid from the lower portion of the first column into the second column;

(C) a turboexpander and means for passing fluid from the upper portion of the first column to the turboexpander;

(D) an intermediate heat exchanger for the second column, means for passing fluid from the turboexpander into the intermediate heat exchanger and means for passing fluid from the intermediate heat exchanger into the second column;

(E) an auxiliary side column having a bottom reboiler, means for passing fluid from the second column into the auxiliary side column, and means for passing fluid from the first column into the auxiliary side column bottom reboiler and from the auxiliary side column bottom reboiler into the first column; and (F) means for recovering fluid from the lower portion of the auxiliary side column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "feed air" means a mixture comprising primarily oxygen and nitrogen, such as ambient air.

As used herein the term "low purity oxygen" means a fluid having an oxygen concentration within the range of from 50 to 98.5 mole percent.

As used herein, the term "high purity nitrogen" means a fluid having an nitrogen concentration greater than 98.5 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or low boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K.).

As used herein, the term "indirect heat exchange" means the bringing of two fluid streams into heat exchange relation without any physical contact or intermixing of the fluids with each other.

As used herein the term "reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "bottom" when referring to a column means that section of the column below the column mass transfer internals, i.e. trays or packing.

As used herein, the term "bottom reboiler" means a reboiler that boils liquid from the bottom of a column.

As used herein, the term "intermediate heat exchanger" means a reboiler that boils liquid from above the bottom of a column.

The numerals in the Figures are the same for the common elements.

DETAILED DESCRIPTION

The invention will be described in detail with reference to the Drawings.

Figure 1:
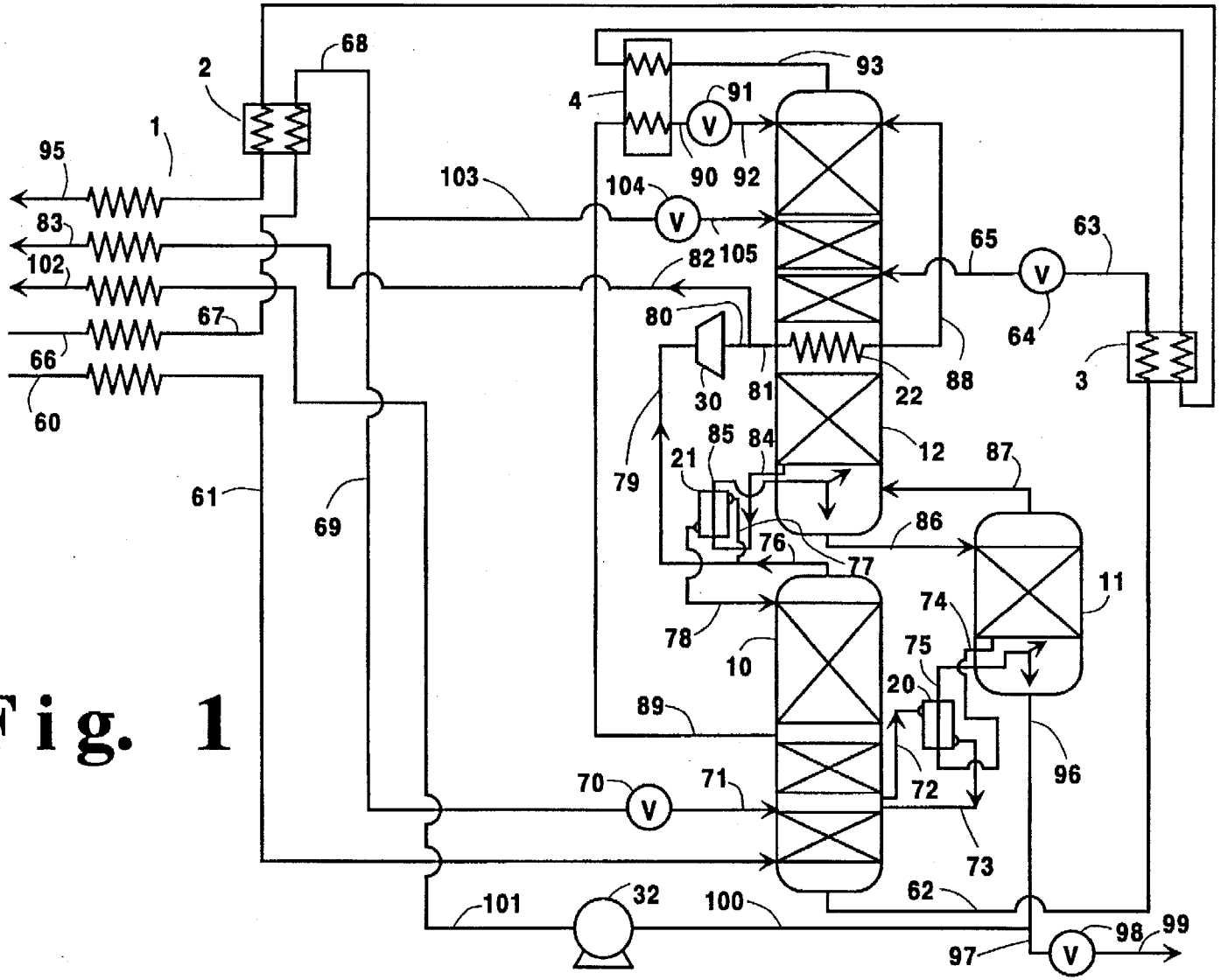
FIG. 1 is a schematic representation of one preferred embodiment of the invention wherein high purity nitrogen is recovered after being turboexpanded.

Referring now to FIG. 1, feed air, which has been cleaned of high boiling impurities such as carbon dioxide and water vapor, is divided into main feed air portion 60 and boosted feed air portion 66. Boosted feed air portion 66 is at an elevated pressure, generally within the range of from 60 to 500 pounds per square inch absolute (psia). The feed air portions are passed through main heat exchanger 1 wherein they are cooled by indirect heat exchange with return streams. Resulting cooled main feed air portion 61 is passed into first or higher pressure column 10, that is operating at a pressure generally within the range of from 60 to 90 psia and that is part of a double column system that also comprises second or lower pressure column 12.

Cooled boosted feed air portion 67 is passed from main heat exchanger 1 to heat exchanger 2 wherein it is subcooled by indirect heat exchange with nitrogen vapor. Resulting subcooled boosted feed air portion 68 is divided into portion 69, which is passed through valve 70 into higher pressure column 10 as stream 71, and into portion 103 which is passed through valve 104 and into lower pressure column 12 in stream 105.

Within first or higher pressure column 10 the feed air is separated by cryogenic rectification into nitrogen-rich vapor and oxygen-enriched liquid. Oxygen-enriched liquid, having an oxygen concentration generally within the range of from 30 to 40 mole percent, is withdrawn from the lower portion of higher pressure column 10 and passed in stream 62 through subcooler 3, wherein it is subcooled by indirect heat exchange with a return stream. Resulting stream 63 is then passed through valve 64 and into second or lower pressure column 12 as stream 65.

Nitrogen-rich vapor is withdrawn from the upper portion of higher pressure column 10 as stream 76. A first portion 77 of the nitrogen-rich vapor is passed into main condenser or bottom reboiler 21 wherein it is condensed by indirect heat exchange with column 12 bottom liquid 84 which is at least partially vaporized and returned to column 12 in stream 85. Resulting nitrogen-rich liquid is passed out of lower pressure column bottom reboiler 21 in stream 78 and back into higher pressure column 10 as reflux.

A second portion 79 of the nitrogen-rich vapor is turboexpanded by passage through turboexpander 30 to generate refrigeration. It is an important aspect of this invention that the nitrogen-rich vapor passed from the higher pressure column 10 to turboexpander 30 is not superheated. This reduces capital costs, simplifies piping and controls, and improves cycle efficiency. The resulting turboexpanded stream 80 is divided into stream 81, which passed into intermediate heat exchanger 22, and into stream 82 which is warmed by passage through main heat exchanger 1 and recovered as product high purity nitrogen in stream 83. Intermediate heat exchanger 22 may be physically within lower pressure column 12 or it may be physically outside lower pressure column 12. When intermediate heat exchanger 22 is physically within column 12 it is located above, generally from 2 to 10 equilibrium stages above, the bottom of column 12, and below, generally from 2 to 10 equilibrium stages below, the point where oxygen-enriched liquid 65 is passed into column 12.

Turboexpanded nitrogen-rich vapor 81 is condensed in intermediate heat exchanger 22 by indirect heat exchange with fluid from above the bottom of the lower pressure column, and resulting nitrogen-rich liquid is passed from heat exchanger 22 in stream 88 into lower pressure column 12. A stream generally having an oxygen concentration within the range of from 0.1 to 0.2 mole percent is taken from a point within the range of from 15 to 30 equilibrium stages above the bottom of higher pressure column 10 and passed from column 10 in stream 89 through subcooler 4 wherein it is subcooled by indirect heat exchange with a return stream. Resulting subcooled stream 90 is passed through valve 91 and into column 12 as stream 92.

Lower pressure column 12 is operating at a pressure lower than that of higher pressure column 10 and generally within the range of from 15 to 30 psia. Within lower pressure column 12 the various fluids passed into the column are separated by cryogenic rectification into nitrogen-richer fluid and oxygen-richer fluid. Nitrogen-richer fluid is withdrawn from the upper portion of lower pressure column 12 as vapor stream 93 which is warmed by passage through subcoolers 4, 3 and 2 and main heat exchanger 1. Resulting stream 95 may be recovered as high purity nitrogen product. The nitrogen from the top of lower pressure column 12 in stream 93 is used to cool several process streams. First it cools the reflux liquid to the column top in stream 89. Second it cools the intermediate reflux liquid in stream 62, and third it cools the liquid feed air to the columns in stream 67. The described heat exchange is shown for clarity as occurring in three separate heat exchangers 4, 3 and 2. Preferably, in practice, all three heat exchangers are combined into a single unit.

Oxygen-richer fluid is passed from the lower portion of lower pressure column 12 in stream 86 into the upper portion of third or auxiliary side column 11 which is operating at a pressure within the range of from 15 to 25 psia. Within auxiliary side column 11 the oxygen-richer fluid is separated by cryogenic rectification into low purity oxygen and remaining vapor. Remaining vapor is returned to the lower portion of column 12 in stream 87.

Auxiliary side column 11 has bottom reboiler 20 which is driven by vapor from higher pressure column 10. Vapor stream 72, having an oxygen concentration generally within the range of from 4 to 10 mole percent, is taken from a point within the range of from 1 to 10, preferably 3 to 5, equilibrium stages above the bottom of higher pressure column 10 and passed into bottom reboiler 20 wherein it is condensed and returned to column 10 in stream 73. Liquid 74 from the bottom of auxiliary side column 11 is also passed into bottom reboiler 20 wherein it is at least partially vaporized and passed back into column 11 in stream 75.

Low purity oxygen is recovered as product from the lower portion of auxiliary side column 11. In the embodiment illustrated in FIG. 1, low purity oxygen is withdrawn from the lower portion of auxiliary side column 11 as liquid stream 96. A portion 97 of liquid stream 96 may be passed through valve 98 and recovered as product low purity oxygen liquid 99. Another portion 100 of stream 96 is increased in pressure by passage through liquid pump 32 and resulting pressurized stream 101, at a pressure generally within the range of from 25 to 250 psia, is vaporized by indirect heat exchange with boosted feed air stream 66 in main heat exchanger 1 and recovered as elevated pressure low purity oxygen gas in stream 102.

Figure 2:
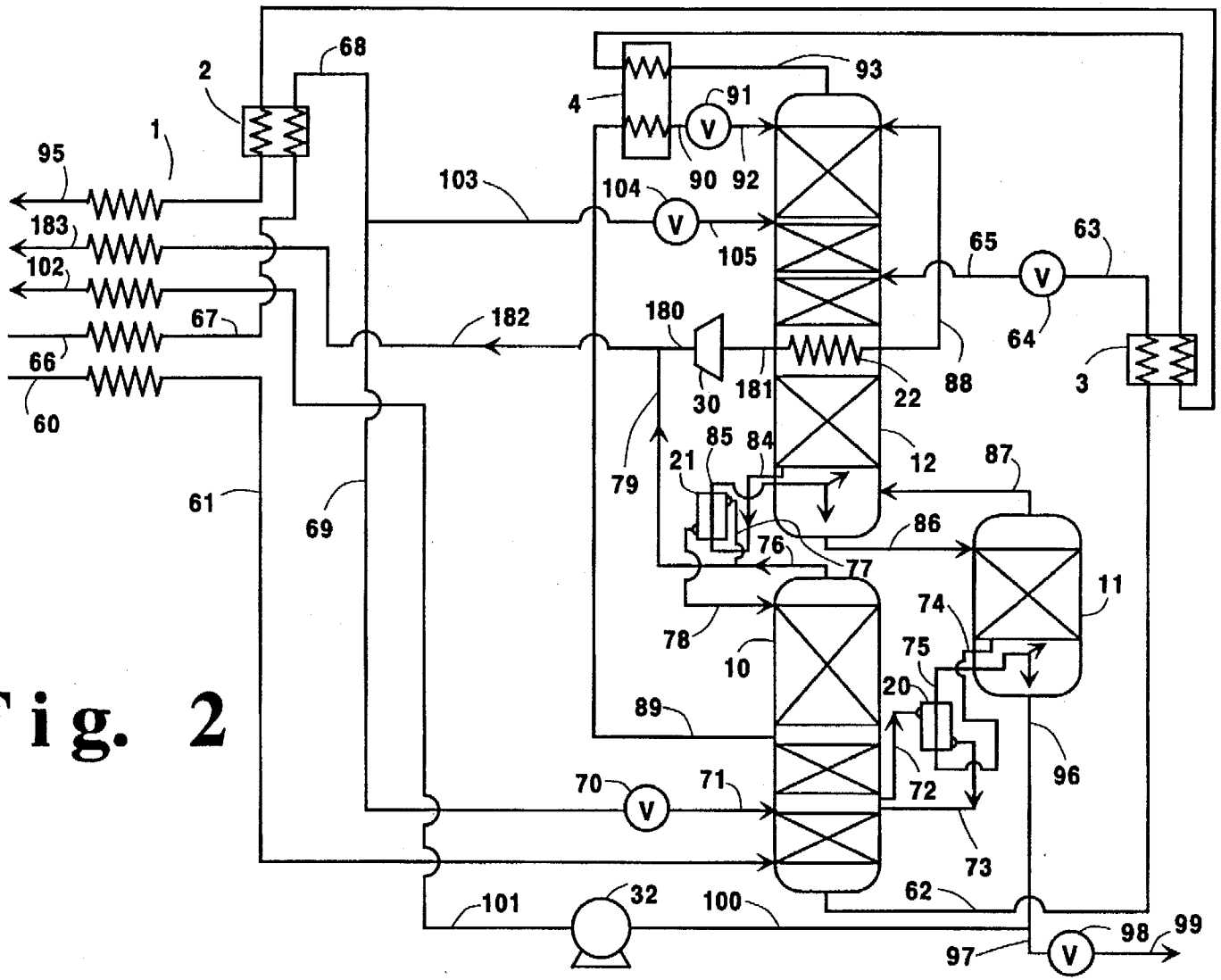
FIG. 2 is a schematic representation of another preferred embodiment of the invention wherein the high purity nitrogen is recovered without being turboexpanded.

FIG. 2 illustrates another preferred embodiment of the invention wherein high purity nitrogen is recovered from the higher pressure column at an elevated pressure. The numerals in FIG. 2 correspond to those of FIG. 1 for the common elements and these common elements will not be described again in detail.

Referring now to FIG. 2, nitrogen-rich vapor stream 79 is divided into streams 182 and 180 upstream of turboexpander 30. Stream 182 is warmed by passage through main heat exchanger 1 and recovered as elevated pressure high purity nitrogen product in stream 183. Nitrogen-rich vapor stream 180 is turboexpanded by passage through turboexpander 30 to generate refrigeration and resulting turboexpanded nitrogen-rich vapor 181 is passed into intermediate heat exchanger 22. The remainder of the process is similar to that illustrated in FIG. 1.

Now with the use of this invention, one can efficiently produce low purity oxygen and high purity nitrogen, and both products can be produced at elevated pressure. The intermediate heat exchanger of the invention utilizes excess driving force available in the stripping section of the lower pressure column to provide refrigeration to sustain the cycle without jeopardizing the driving force in the upper rectifying section of the column. The refrigeration is produced by the turboexpansion of nitrogen-rich vapor from the higher pressure column. This refrigeration displaces refrigeration generally produced by conventional expansion of an elevated pressure feed air stream into an intermediate point in the lower pressure column. As a result, a substantial quantity of high purity nitrogen may be withdrawn from the column system and recovered at elevated pressure. This reduces capital requirements, reduces process irreversibility, and improves product recoveries for a given work input over that possible with conventional practice.

Although the invention has been described in detail with reference to certain preferred embodiments, those skilled in the art will recognize that there are other embodiments of the invention within the spirit and the scope of the claims.

We claim:

1. A method for producing low purity oxygen and high purity nitrogen comprising:

(A) passing feed air into a higher pressure column and separating the feed air within the higher pressure column by cryogenic rectification into nitrogen-rich vapor and oxygen-enriched liquid;

(B) recovering a portion of the nitrogen-rich vapor as product high purity nitrogen, and passing oxygen-enriched liquid into a lower pressure column;

(C) turboexpanding a portion of the nitrogen-rich vapor to produce turboexpanded nitrogen-rich vapor, condensing turboexpanded nitrogen-rich vapor by indirect heat exchange with fluid from above the bottom of the lower pressure column to produce nitrogen-rich liquid, and passing nitrogen-rich liquid into the lower pressure column;

(D) separating the fluids passed into the lower pressure column by cryogenic rectification into nitrogen-richer fluid and oxygen-richer fluid;

(E) passing oxygen-richer fluid into an auxiliary side column and producing low purity oxygen by cryogenic rectification within the auxiliary side column, wherein liquid from the auxiliary side column is vaporized by indirect heat exchange with vapor from within 1 to 10 equilibrium stages above the bottom of the higher pressure column; and (F) recovering low purity oxygen product from the auxiliary side column.

2. The method of claim 1 wherein the nitrogen-rich vapor portion is turboexpanded prior to being recovered as product high purity oxygen.

3. The method of claim 1 wherein low purity oxygen is withdrawn from the auxiliary side column as liquid, increased in pressure and vaporized by indirect heat exchange with a feed air stream prior to recovery as product low purity oxygen.

4. The method of claim 1 further comprising passing fluid taken from a point within the range of from 15 to 30 equilibrium stages above the bottom of the higher pressure column into the lower pressure column.

5. The method of claim 1 further comprising recovering nitrogen-richer fluid from the lower pressure column as high purity nitrogen product.

6. Apparatus for producing low purity oxygen and high purity nitrogen comprising:

(A) a first column, a second column and means for providing feed air into the first column;

(B) means for recovering fluid from the upper portion of the first column, and means for passing fluid from the lower portion of the first column into the second column;

(C) a turboexpander and means for passing fluid from the upper portion of the first column to the turboexpander;

(D) an intermediate heat exchanger for the second column, means for passing fluid from the turboexpander into the intermediate heat exchanger and means for passing fluid from the intermediate heat exchanger into the second column.

(E) an auxiliary side column having a bottom reboiler, means for passing fluid from the second column into the auxiliary side column, and means for passing fluid from the first column into the auxiliary side column bottom reboiler and from the auxiliary side column bottom reboiler into the first column; and (F) means for recovering fluid from the lower portion of the auxiliary side column.

7. The apparatus of claim 6 wherein the means for recovering fluid from the upper portion of the first column includes the turboexpander.

8. The apparatus of claim 6 wherein the means for recovering fluid from the lower portion of the auxiliary side column includes a liquid pump.

9. The apparatus of claim 6 further comprising means for passing fluid taken from 15 to 30 equilibrium stages above the bottom of the first column into the upper portion of the second column.

10. The apparatus of claim 6 further comprising means for recovering fluid taken from the upper portion of the second column.

* * * * *